US006629537B2

(12) United States Patent
Gueret

(10) Patent No.: US 6,629,537 B2
(45) **Date of Patent: *Oct. 7, 2003**

(54) MAKE-UP CASE WITH SEAL

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/842,820

(22) Filed: Apr. 27, 2001

(65) Prior Publication Data

US 2002/0124863 A1 Sep. 12, 2002

Related U.S. Application Data

(62) Division of application No. 09/319,695, filed as application No. PCT/FR98/02273 on Oct. 23, 1998, now Pat. No. 6,293,286.

(30) Foreign Application Priority Data

Oct. 24, 1997 (FR) ..... 97 13360
Oct. 24, 1997 (FR) ..... 97 13361

(51) Int. Cl.[7] ..... A45D 33/04

(52) U.S. Cl. ..... 132/299; 132/293; 132/307; 220/264; 220/849; 220/806; 220/795

(58) Field of Search ..... 206/581; 220/23.89, 220/23.87, 263, 264, 459.05, 833, 834, 835, 849, 795, 806, 827; 132/293, 294, 299, 307

(56) References Cited

U.S. PATENT DOCUMENTS

| | | | |
|---|---|---|---|
| 3,841,466 | A | 10/1974 | Hoffman et al. |
| 4,311,317 | A | 1/1982 | Bartels |
| 4,454,889 | A | 6/1984 | Contreras, Sr. |
| 4,569,438 | A | 2/1986 | Sheffler |
| 5,186,318 | A | 2/1993 | Oestreich et al. |
| 5,865,194 | A | 2/1999 | Gueret |
| 5,896,866 | A | 4/1999 | Quennessen |
| 5,938,016 | A | 8/1999 | Erdtmann |

FOREIGN PATENT DOCUMENTS

| | | |
|---|---|---|
| DE | 1 093 523 | 11/1960 |
| DE | 92 12 422.4 | 1/1993 |
| EP | 0 522 086 A1 | 7/1993 |
| EP | 0 790 017 A1 | 8/1997 |
| EP | 0 861 613 A2 | 9/1998 |
| FR | 2 535 814 | 5/1984 |
| FR | 2 741 042 | 5/1997 |
| GB | 562801 | 7/1944 |

*Primary Examiner*—David T. Fidei
(74) *Attorney, Agent, or Firm*—Oliff & Berridge, PLC

(57) ABSTRACT

A case includes a lid and a case body provided with a traversing aperture. The aperture accommodates a reserve of product contained in a cup. The case includes a seal secured to the cup and pressing in a sealed manner against the case body.

102 Claims, 8 Drawing Sheets

Figure 4:
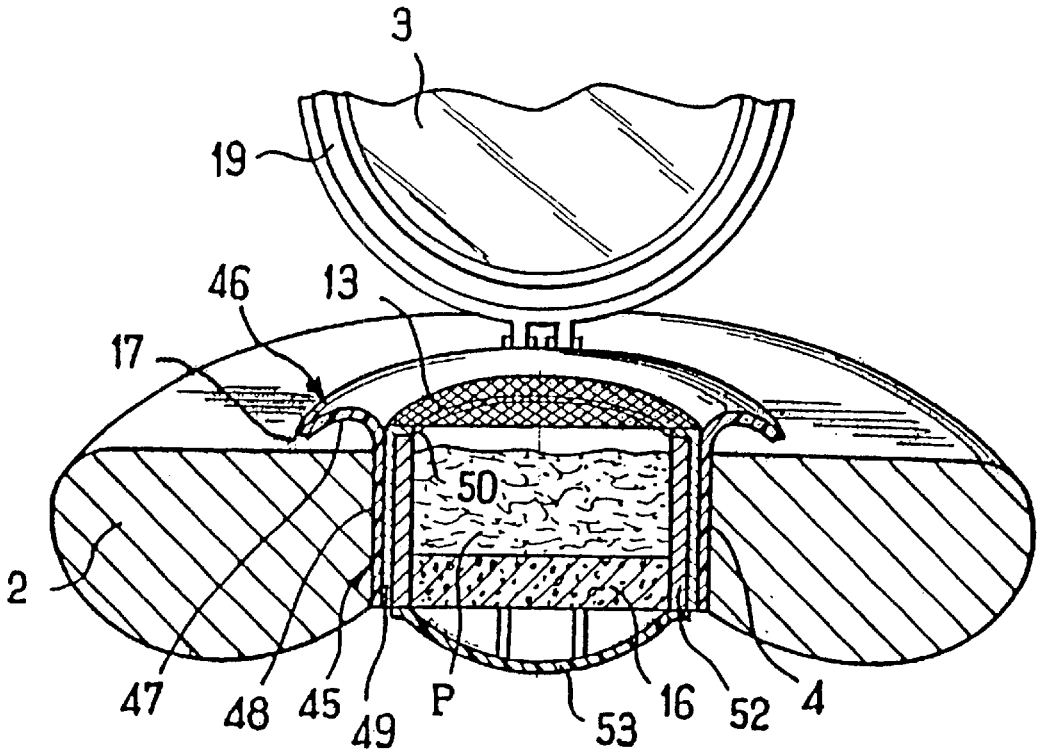

FIG_1
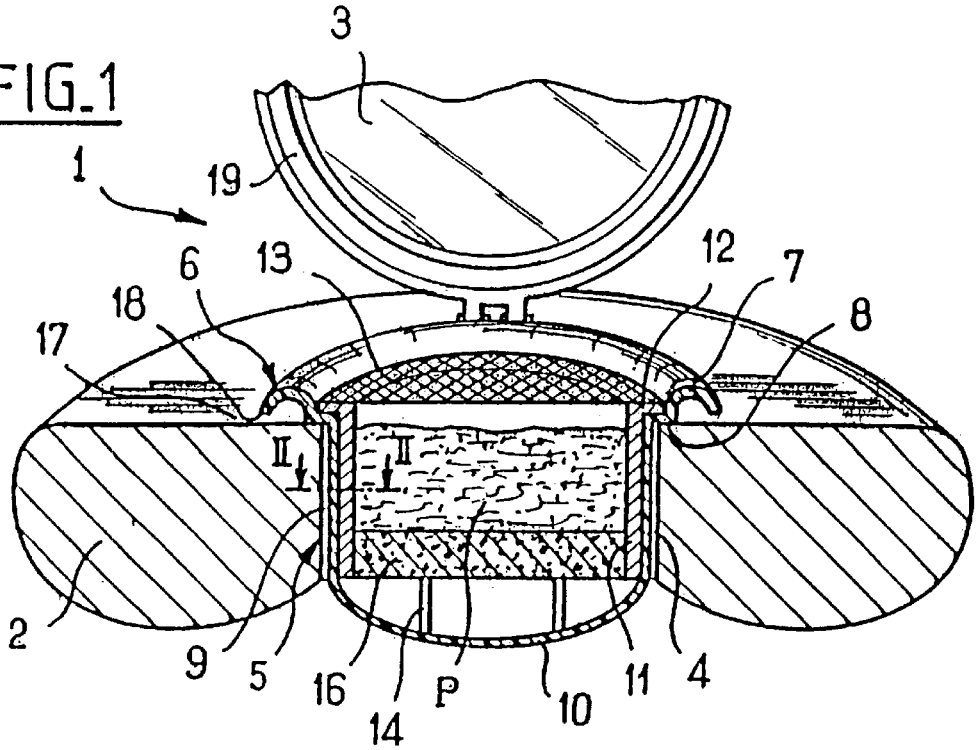
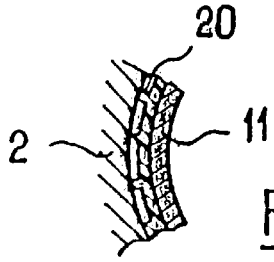
FIG_2
FIG_3
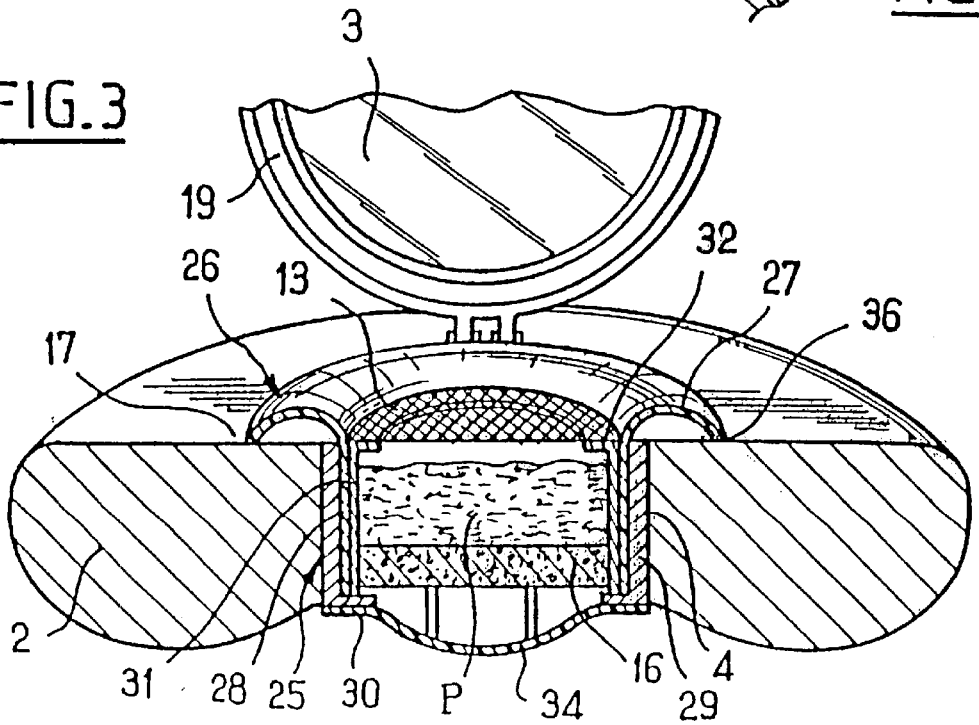

MAKE-UP CASE WITH SEAL

This is a Division of application Ser. No. 09/319,695 filed Aug. 5, 1999, now U.S. Pat. No. 6,293,286, which is a 371 PCT/FR98/02273 filed Oct. 23, 1998. The entire disclosure of the prior application(s) is hereby incorporated by reference herein in its entirety.

The present invention relates to a make-up case comprising a lid and a holed case body accommodating a reserve of product contained in a cup.

This type of case has the advantage that it makes it possible for the cup to be extracted so that it can be replaced by another, for example simply by pushing on its bottom.

This may also make it possible to use a cup which has a flexible bottom, so if necessary to make it easier for product contained in the cup to be withdrawn by pushing the product up in the cup by exerting pressure on the bottom of the cup.

The product in the cup may contain volatile solvents and the case must prevent these solvents from evaporating when the lid is closed, because otherwise the product will not keep well.

In the absence of solvents, when the product consists of a powder for example, there is also benefit to be had in ensuring sealed closure to prevent risk of product leakage.

European patent application EP-A-790,017 has proposed that the case be sealed when the lid is closed using a puff which at its periphery has a roll that acts as a seal.

This solution is not entirely satisfactory, and there is a need to further improve the sealed closure of the case.

The subject of the invention is thus a case of the type comprising a lid and a holed case body, accommodating a reserve of product contained in a cup, this case being characterized in that it comprises a seal secured to the cup and pressing in sealed manner against the case body.

Thus, it is possible to avoid solvents or product escaping from the case, when the lid is closed, through the hole in the case body in which the cup is fitted.

In a particular embodiment, the seal is made as a single piece with the bottom of the cup and from the same material.

It is thus possible to guarantee that the product contained in the cup will keep very well when the case is closed.

In a particular embodiment, the seal comprises a skirt pressing with friction against the wall of the housing in the case body in which the cup is accommodated.

The elasticity of the material of which the seal is made thus advantageously plays a part in holding the cup in place and furthermore makes it possible to take up any clearance in the mounting or makes it possible to allow wider manufacturing tolerances on the case body and on the cup.

Advantageously, the aforementioned skirt has axial ribs distributed around its periphery, these ribs pressing on the wall of the housing of the case body to retain the cup.

In a particular embodiment, the seal presses in sealed manner against the wall of the housing of the case body accommodating the cup.

In a particular embodiment, the seal is secured to a rigid plastic ring which serves for the attachment of a mesh over the cup.

This mesh is advantageously welded at its periphery to the said rigid plastic ring.

An annular surface is advantageously formed on the ring around the mesh to serve for the attachment of a removable closure sheet.

The seal is advantageously overmoulded onto the said ring.

In a particular embodiment, the seal has a flexible lip.

The seal may furthermore comprise, at the base of the said flexible lip, a heel which presses in sealed manner against the case body.

The aforementioned flexible lip may press in sealed manner against the case body.

When such is the case even when the case is open, the sealed manner in which the cup is mounted in the case body is improved and product is prevented from getting between the cup and the case body during use, as this would detract from the appearance of the case.

The build-up of dirt is avoided, and the surface of the case body becomes easier to clean.

In one particular embodiment, the flexible lip presses in sealed manner against an annular rib projecting from the case body.

This annular rib may, on the one hand, play a part in sealing the mounting of the cup in the case body and, on the other hand, encourage the deformation of the sealing lip around a hinge-forming zone.

Thus, part of the seal can remain substantially the same shape irrespective of whether the lid is open or closed, while the rest of the sealing lip can flex when the case is closed by virtue of the hinge-forming zone.

In a particular embodiment, the lid comprises an annular rib of larger diameter than the annular rib of the case body, pressing against the flexible lip when the case is in the closed position.

As an alternative, the lid may, when in the closed position, press via its periphery on the flexible lip of the seal.

The seal thus plays a part not only in sealing the mounting of the cup in the case body but also seals the case when the lid is closed.

In a particular embodiment, the annular rib of the lid presses on the flexible lip without substantially compressing its free end.

It is thus possible to reduce the risk of the sealing lip being excessively compressed by the lid and, in the event of long-term storage, losing memory of its initial shape.

In a particular embodiment, the lid comprises concentric annular ribs, of respective diameters smaller than and greater than that of the said annular rib projecting from the case body, and which press against the flexible lip one on each side of the rib of the case body.

In a particular embodiment, the seal comprises a peripheral part which has the overall shape of an inverted U, comprising two arms housed in a groove of the case body and connected by an outwardly convex rounded part.

In a particular embodiment, the lid comprises a projecting element, preferably a seal, which via its lower end presses against the aforementioned rounded part.

In a particular embodiment, the seal comprises a peripheral part which in cross section has undulations and presses in sealed manner via a lower ridge against the case body.

In a particular embodiment, the seal defines two grooves facing towards the case body, the said grooves lying one on each side of a central groove facing towards the lid when the case is closed, the seal comprising, at the bottom of the said grooves that face towards the case body, rests moulded integrally with the seal, these rests resting against the case body.

In a particular embodiment, the lid comprises an annular rib which engages in the said central groove when the case is closed.

In a particular embodiment, the seal comprises a peripheral part which in cross section has a shape that is concave towards the case body, and one or more stiffening elements is or are provided inside the said concave part.

In a particular embodiment, the seal comprises a number of stiffening elements extending radially and moulded integrally with the rest of the seal.

As an alternative, the seal comprises a stiffening element in the form of a continuous or discontinuous annular rib extending over the entire height of the peripheral part of the seal with a concave shape in cross section.

A further subject of the invention is a case characterized in that one out of the lid or the body of the case comprises at least one kidney bean slot and in that the other out of the lid or the body of the case comprises a hinge pin engaged in the said slot, the arrangement of the said slot and of the said hinge pin being such that when the lid is closed, the hinge pin can move in the said slot so that the lid presses substantially uniformly against the seal.

Yet a further subject of the invention is seals for a make-up case of the type comprising a case body and a lid, these seals exhibiting the specific features mentioned above.

Figure 5:
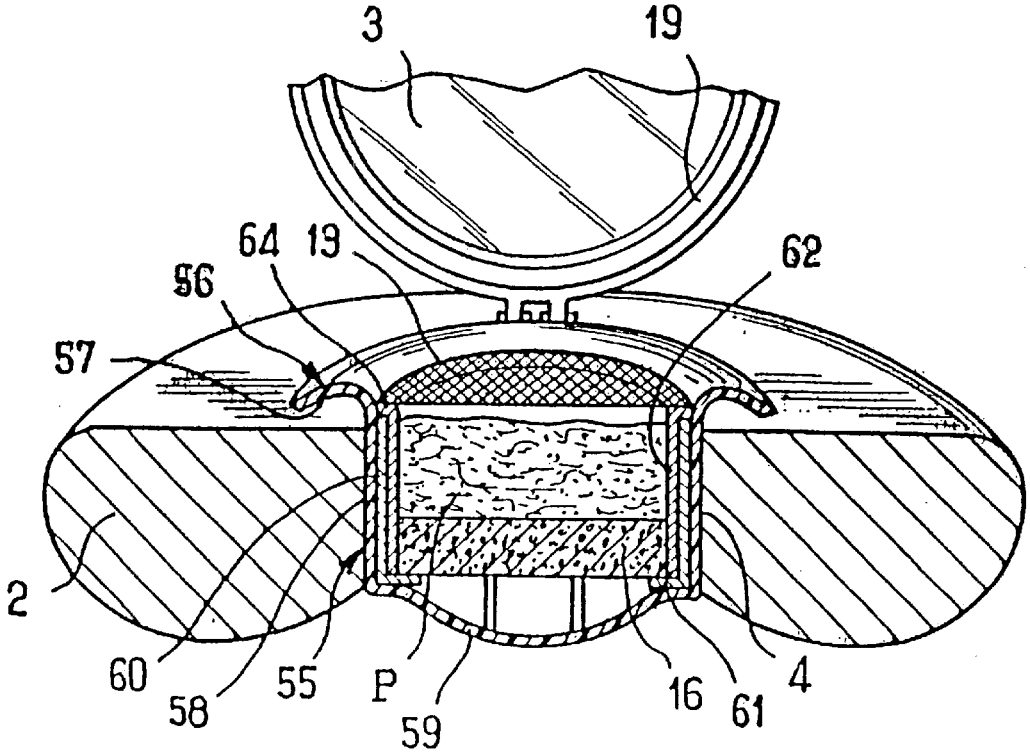
Figure 6:
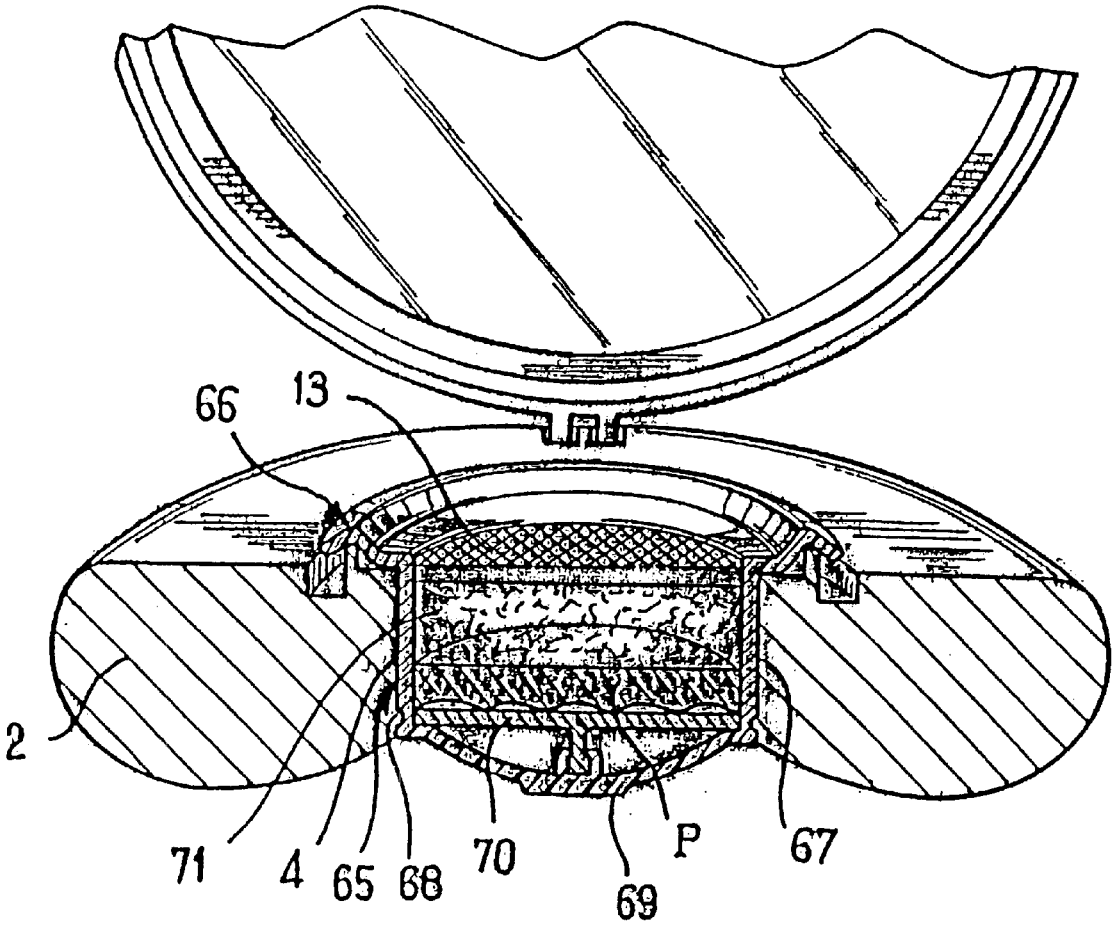
Figure 7:
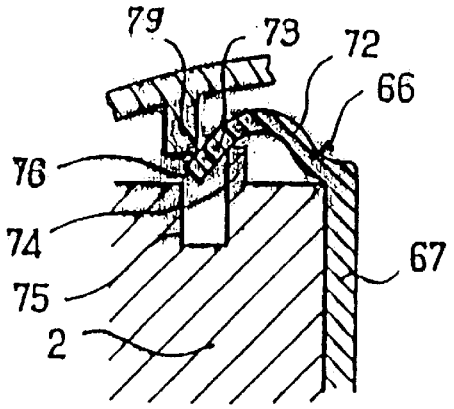
Figure 22:
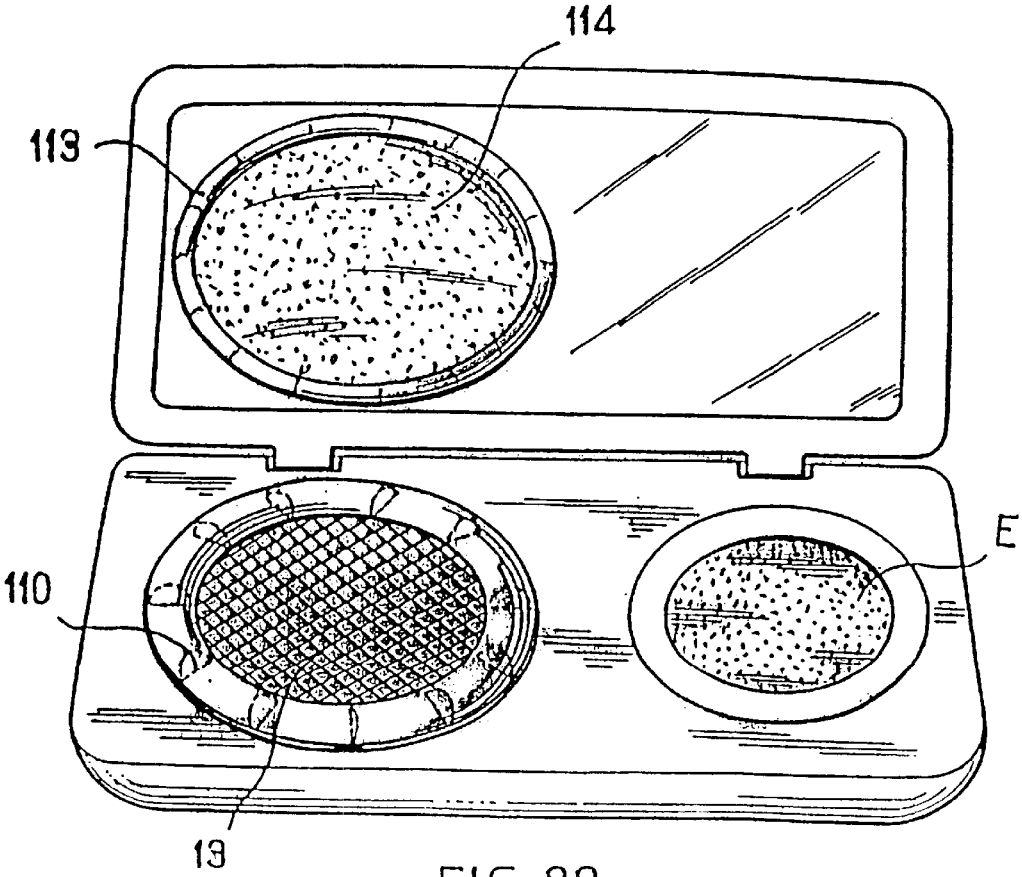
Figure 23:
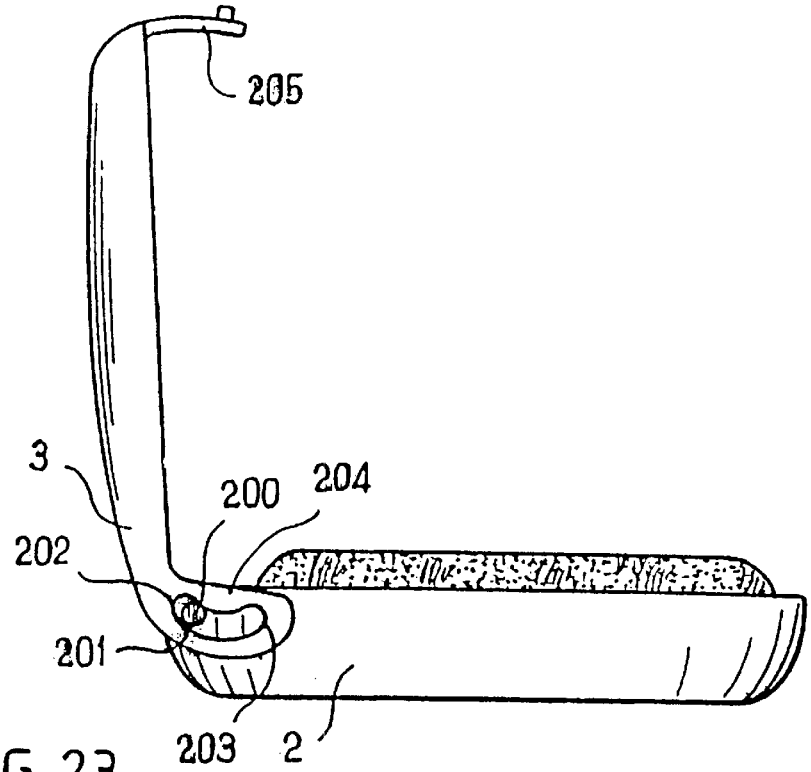
Figure 24:
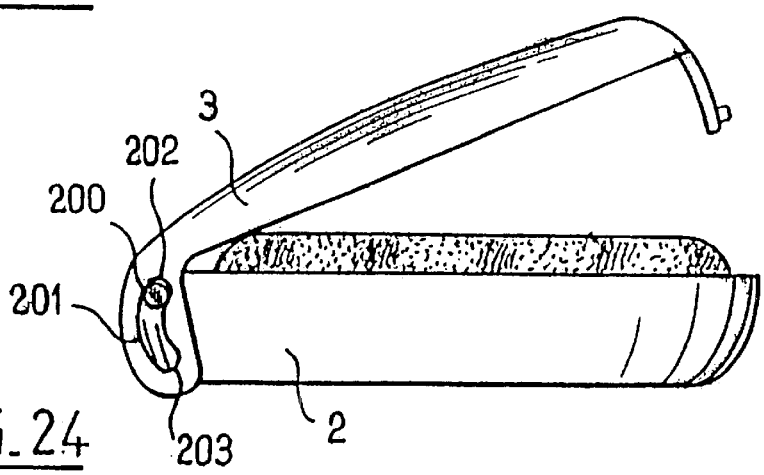
Figure 25:
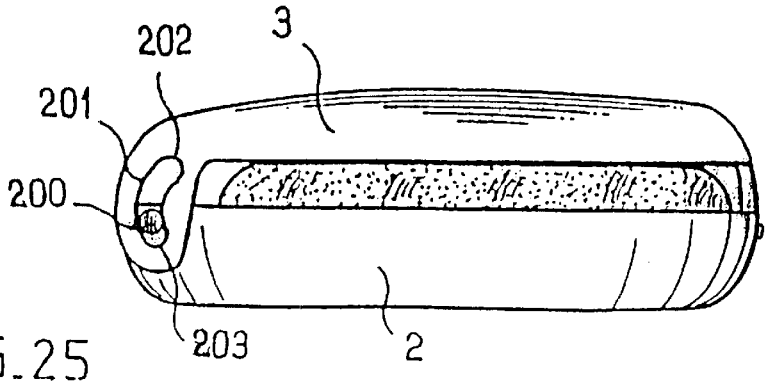

Other features and advantages of the present invention will become clear from reading the detailed description which will follow, of non-limiting embodiments of the invention, and from examining the appended drawing, in which:

FIG. 1 is a diagrammatic sectioned view of a make-up case in accordance with a first embodiment of the invention, FIG. 2 is a partial and diagrammatic view in section on sectioning line II—II of FIG. 1, FIG. 3 is a diagrammatic sectioned view of a make-up case in accordance with a second embodiment of the invention, FIG. 4 is a diagrammatic sectioned view of a make-up case in accordance with a third embodiment of the invention, FIG. 5 is a diagrammatic sectioned view of a make-up case in accordance with a fourth embodiment of the invention, FIG. 6 is a diagrammatic sectioned view of a make-up case in accordance with a fifth embodiment of the invention, FIG. 7 depicts a detail of the case in accordance with the fifth embodiment illustrated in FIG. 6, FIGS. 8 to 22 depict various ways of achieving sealing with the lid, FIGS. 23 to 25 illustrate a particular embodiment of the hinge by means of which the lid can be articulated to the body of the case.

FIG. 1 depicts a make-up case 1 comprising a case body 2 and a lid 3 articulated thereto. The case body 2 is holed in its central part to form a cylindrical housing 4 housing a cup 5 containing a reserve of product P.

The cup 5 carries a seal 6 which seals its mounting in the case body 2.

In the embodiment described, the seal 6 comprises an annular flexible lip 7 of roughly semi-circular cross section, the concave side of which faces towards the case body 2.

This flexible lip 7 is connected to a heel 8, itself extended downwards by a skirt 9 which connects to the bottom 10 of the cup.

In the embodiment described, the flexible lip 7, the heel 8, the skirt 9 and the bottom 10 are made as a single piece of elastomer, the heel 8 and the skirt 9 furthermore being overmoulded onto a ring 11 made of a relatively rigid plastic.

This ring 11 has a body which is cylindrical overall, ending at its upper end in a rim 12 which points radially outwards, surmounting the heel 8 and serving for the attachment of a mesh 13, the latter being welded at is periphery to the rim 12.

The cup 5 comprises a block of foam 16 resting on an annular rib 14 forming a projection from the interior face of the bottom 10.

The block of foam 16 has a diameter tailored to that of the body of the ring 11 and acts somewhat like a piston to drive the product P through the mesh 13 when the user presses on the bottom 10.

In the embodiment of FIG. 1, the free end 18 of the flexible lip 7 extends as far as a short distance from the upper face 17 of the case body 2, and the mounting of the cup 5 in the case body 2 is sealed by means of the heel 8 which presses in sealed manner against the case body 2.

The lid 3 is designed in such a way that its edge 19 presses in sealed manner against the flexible lip 7 when the case is closed, causing this lip to flex downwards slightly without it, however, being compressed against the case body.

The skirt 9 is provided on its periphery with axial ribs 20, as can be seen in FIG. 2, which ribs ensure that the cup is held by friction in the case body and allow relatively wide manufacturing tolerances on the case body or on the cup.

In an alternative form which has not been depicted, an annular surface is formed on the rim 12 around the mesh 13 and serves for the attachment, by thermal welding, for example, of a removable sealed closure which is removed at the time of first use once the cup has been mounted in the case body.

In what follows of the description, the same reference symbols may be used to denote elements which are identical or similar and which will not be described again in detail.

The case depicted in FIG. 3 differs from the one depicted in FIG. 1 in the structure of the cup accommodated in the housing 4, which bears the reference 25.

The cup 25 bears a seal 26 which has an annular flexible lip 27 connected to a skirt 28.

The lip 27 and the skirt 28 are made as a single piece of elastomer, the skirt 28 furthermore being overmoulded onto the interior face of a ring 29 made of a relatively rigid plastic.

This ring 29 is force-fitted in the housing 4 of the case body 2 and its lower end has an annular rim 30 pointing radially inwards.

A second ring 31 which may be made of the same material as the first ring is inserted inside the skirt 28 and at its upper end has a rim 32 which serves for the attachment of the mesh 13.

A flexible bottom 34 is fixed at its periphery, for example by overmoulding, onto the lower face of the rim 30.

The ring 31 presses at its lower end on the rim 30.

The flexible lip 27 in cross section has a substantially semi-circular shape and presses, via its free edge 36, against the upper face 17 of the case body 2, so that the cup 25 is mounted in sealed manner in the case.

The lid 3 presses via its edge 19 on the flexible lip 27 when the case is closed.

The case depicted in FIG. 4 differs from the previous ones in the structure of the cup, which has the reference 45.

This cup 45 bears a seal 46 which has an annular lip 47 which connects to a skirt 48 which presses against the wall of the housing 4 so that the cup can be mounted in sealed manner and retained by friction in the case body 2.

The flexible lip 47 and the skirt 48 are made as a single piece of elastomer, the skirt 48 furthermore being overmoulded onto a ring 49 made of a relatively rigid plastic and provided at its upper end with a rim 50 projecting radially inwards to serve for the attachment of the mesh 13.

A second ring 52 which be made of the same plastic as the first is force-fitted into the latter, bearing at its upper end against the rim 50.

A flexible bottom 53 is fixed to the lower end of this ring 52.

The case depicted in FIG. 5 comprises a cup which bears the reference 55.

This cup 55 carries a seal 56 comprising a flexible annular lip 57 made as a single piece with a skirt 58 and with the bottom 59 of the cup.

The skirt 58 presses in sealed manner against the wall of the housing 4.

It is overmoulded onto a ring 60, made of a relatively rigid plastic, equipped at its lower end with a rim 61 pointing radially inwards and on the lower face of which the bottom 59 is fixed at its periphery.

A second ring 62, made of a relatively rigid plastic, is force-fitted into the first ring and at its upper end has a rim 64 pointing radially outwards and serving for the attachment of the mesh 13.

FIG. 6 illustrates yet another way of producing the cup, which in this figure bears the reference 65.

The cup 65 comprises a seal 66 integral with the body 67 of the cup and made of a relatively rigid plastic.

The housing 4 in the case body 2 has a bulge 68 which allows the snap-fastening of the body 67.

The body 67 connects at the bottom to a bottom 69 made of flexible plastic, for example elastomer.

A piston 70 is mounted inside the body 67, underneath the product P.

A block of foam 71 is inserted between the mesh 13 and the product P to make dispensing more uniform.

FIGS. 7 to 15 illustrate various ways of sealing the mounting of the cup in the case body 2 and of sealing the case when the lid is closed.

In the example of FIG. 7, the seal comprises an annular lip 72 which is generally semi-circular in cross section, the descending part 73 of this lip pressing against an annular rib 74 made as a projection from the upper face of the case body 2.

An annular groove 75 is formed around this rib 74.

The lid comprises an annular rib 79 which presses in sealed manner against the descending part 73, as depicted in FIG. 7, when the case is closed.

It will be noted in this figure that the free end 76 of the lip is not compressed, because of the presence of the groove 75.

Figure 8:
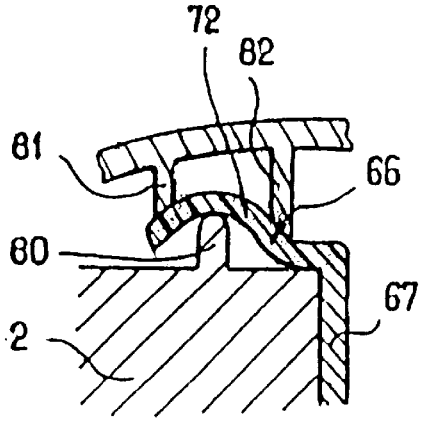

In the alternative form depicted in FIG. 8, the sealing lip 72 presses on an annular rib 80 projecting from the case body and the lid has two annular ribs 81 and 82 of respective diameters greater than and smaller than that of the rib 80, pressing in sealed manner against the lip 72 when the lid is closed.

The pressing of the lip 72 on the rib 80 seals the mounting of the cup in the case body when the case is closed, and the pressing of the ribs 81 and 82 on the lip 72 seals the closing of the lid.

Figure 9:
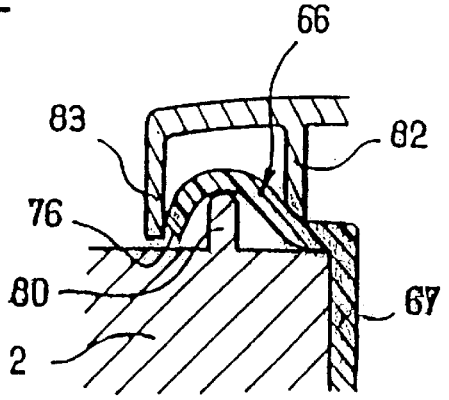

In the alternative form of FIG. 9, the rib 81 is replaced by the edge 83 of the lid, which advantageously presses against the free end 76 of the sealing lip, as illustrated.

Figure 10:
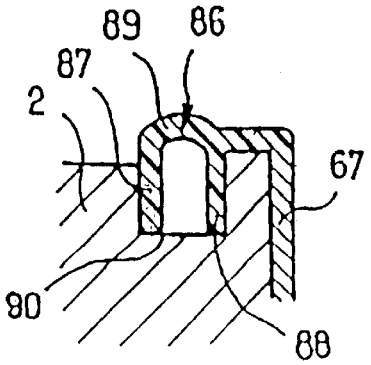

In the embodiment of FIG. 10, the seal, referenced 86, comprises a peripheral part which in cross section has the overall shape of an inverted U comprising two arms 87, 88 connected by an outwardly convex rounded part 89.

The two arms 87, 88 are housed in a groove 90 of the case body 2 and seal the mounting of the cup in the case body.

Figure 11:
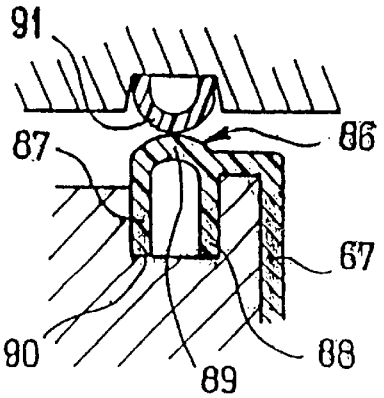

The lid may have a projecting element 91 consisting for example of a seal as depicted in FIG. 11, pressed in sealed manner against the rounded part 89 so as to seal the closing of the case.

Figure 12:
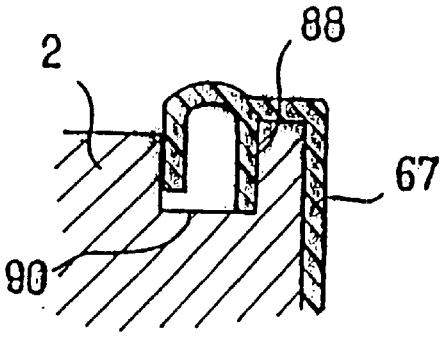

The arm 87 may, in an alternative form, be slightly shorter than the arm 88, as illustrated in FIG. 12, which allows for greater deformation of the seal when the lid is closed.

Figure 13:
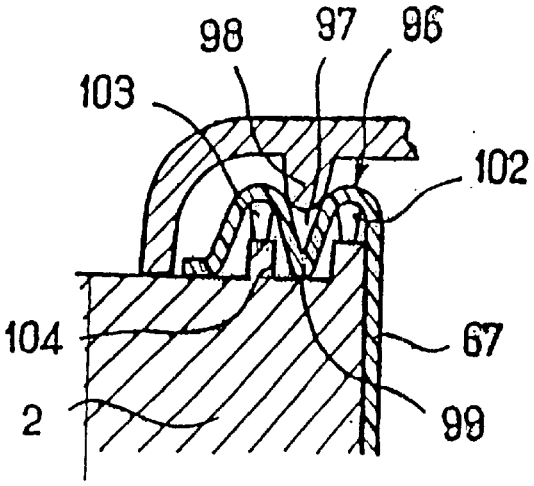
Figure 14:
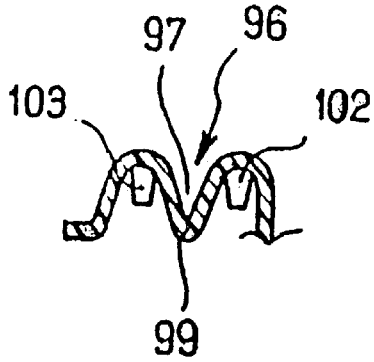
Figure 15:
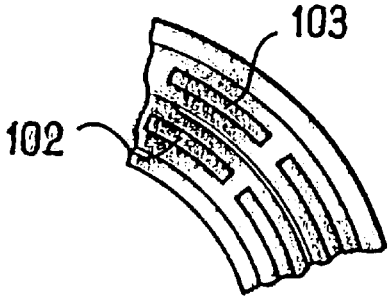

In the alternative forms of FIGS. 13 to 15, the seal, which overall bears the reference 96 and which is depicted separately in FIG. 14, comprises a peripheral part which in cross section has undulations which define a central annular groove 97 in which a rib 98 of the lid is engaged in sealed manner when the case is closed.

The seal 96 therefore presses via its lower ridge 99 against the case body, and this seals the mounting of the cup.

The seal 96 defines annular grooves which are open towards the case body, comprising discontinuous stiffening ribs 102 and 103, as illustrated in FIG. 15.

These stiffening ribs 102 and 103 press against the case body 2 as illustrated in FIG. 13.

A groove 104 is made in the case body between the zones against which the ribs 102 and 103 rest, to house the ridge 99.

Figure 16:
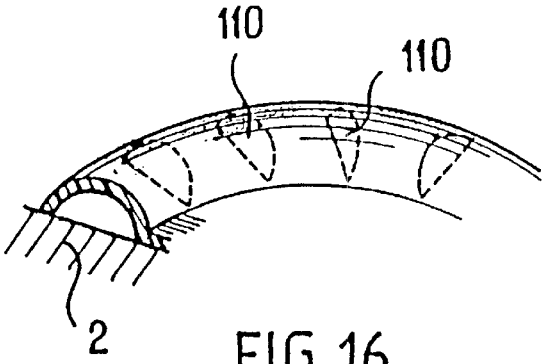

When the seal comprises a peripheral part which in cross section has a shape which overall is concave towards the case body, it is possible, as illustrated in FIG. 16, to produce stiffening webs 110 on the interior surface of the seal, which webs may be useful when the lid is sealed when the case is closed by means of the lid pressing against the seal.

Figure 17:
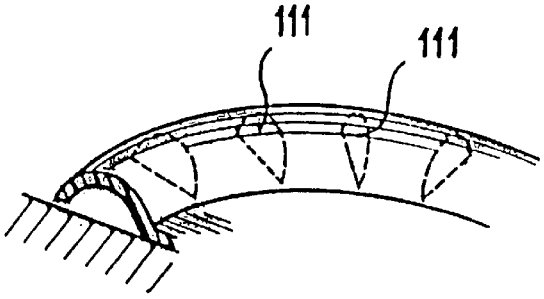
Figure 18:
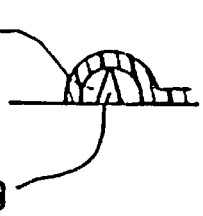

The stiffening webs 110 may extend as depicted in FIG. 16 across the entire width of the concave part of the seal or, as an alternative, may extend over just part of its width, as illustrated in FIGS. 17 or 18.

In FIG. 17, the stiffening webs, which bear the reference 111, are truncated at their radially outermost end so as to allow the free end of the seal a certain amount of flexibility.

In the example of FIG. 18, the stiffening webs which bear the reference 112, comprise a central recess 113 in the form of a triangular cutout which allows the seal a certain amount of deformation about a hinge zone situated at the apex of the cutout.

Figure 19:
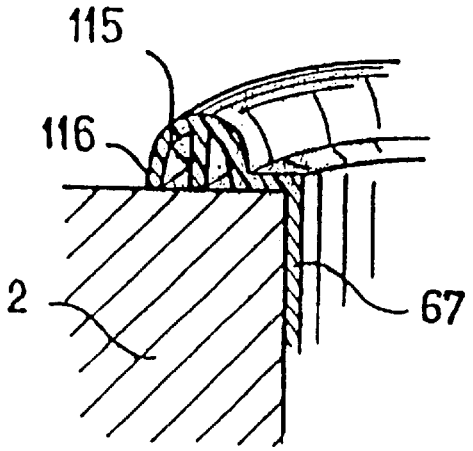

The stiffening element located inside the concave part of the peripheral part of the seal may alternatively be in the form of a continuous or discontinuous annular rib 115, as illustrated in FIG. 19.

Figure 20:
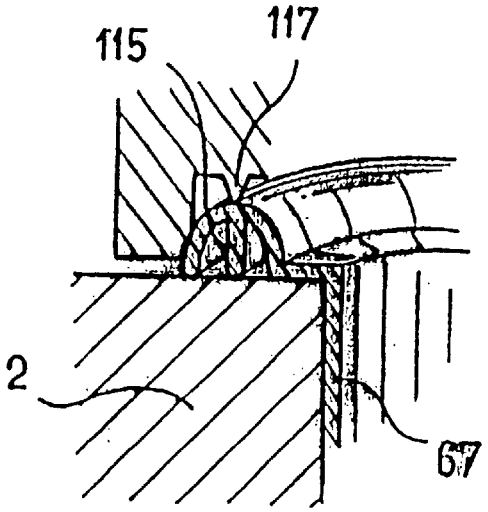

The lid may press on the seal both via its edge on the radially outermost descending part 116 and via an annular rib 117 on the crown of the seal, as illustrated in FIG. 20.

Figure 21:
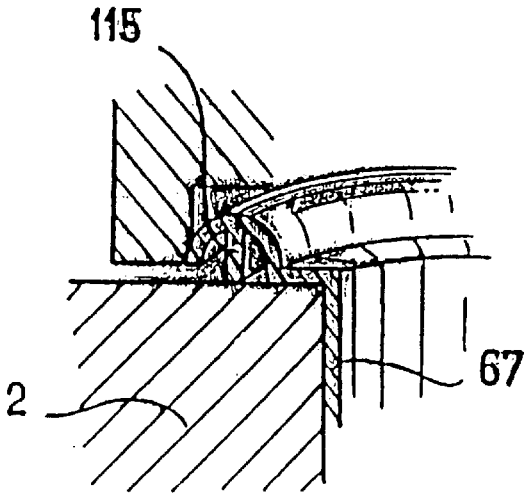

As an alternative, as depicted in FIG. 21, just the edge of the lid presses on the radially outermost part of the seal, which may furthermore not come into contact with the case body but simply flex downwards.

FIG. 22 depicts a make-up case comprising a case body with a housing accommodating a cup bearing, for example, a seal which has a peripheral part as described with reference to FIG. 16.

The lid has an annular rib 113 which presses on the seal when the case is in the closed position, this rib 113 surrounding a foam pad 114 which comes into contact with the mesh 13 to smooth the surface of the product when the case is closed.

The case body furthermore comprises a second housing accommodating an applicator member E known per se.

FIGS. 23 to 25 illustrate an advantageous way of producing the hinge which allows the lid to be articulated to the case body, irrespective of the latter's type.

As a preference, use is made of a pin 200 fixed to the body 2 of the case and the ends of which protrude from the latter to act as pivots for the lid.

More specifically, the said ends are engaged in two kidney bean slots 201 in the lid 3, these slots 201 being made in cheeks 204 which are generally directed at right angles to the plane of the lid.

A clasp 205 is provided on the opposite side to the hinge, so as to keep the lid in the closed position, in a way known per se.

When the case is open, as depicted in FIG. 23, the ends of the pin 200 lie near the ends 202 of the slots 201 closest to the top of the lid. The pin 200 remains in the same position relative to the slots 201 during the start of the phase of closing the lid, as long as the latter is not pressing on the seal, as illustrated in FIG. 24.

The seal may be one of the seals described earlier.

When the lid presses on the seal, the rotation of the lid is accompanied by a sliding of the pin 200 in the slots 201 towards the ends 203 furthest from the top of the lid, so that the latter presses substantially uniformly on the seal.

Of course, the invention is not restricted to the embodiments described.

In particular, the articulation between the lid and the case body and the sealing of the mounting of the cup may be achieved in yet other ways, without departing from the scope of the invention.

What is claimed is:

1. A case comprising:

a lid, a case body having a housing, and a cup containing a reserve of substance, said cup being accommodated in the housing of said case body, wherein said cup is extended by a seal having an outer peripheral edge, said outer peripheral edge, at least in an open position of said case, being spaced from said case body, wherein an annular surface is formed on a ring secured to said seal to serve for the attachment of at least either one of a removable closure sheet and a mesh.

2. The case according to claim 1, wherein said case body is provided with a traversing aperture.

3. The case according to claim 1, wherein said seal is pressing in a sealed manner against said case body.

4. The case according to claim 1, wherein said seal has a skirt that is held by friction by a wall of said housing.

5. The case according to claim 1, wherein said seal is overmolded onto said ring.

6. The case according to claim 1, wherein said lid presses in a sealed manner onto said seal when said lid is in a closed position.

7. The case according to claim 1, wherein said seal comprises a flexible lip.

8. The case according to claim 7, wherein said seal comprises at the base of said flexible lip a heel which contacts in a sealed manner said case body.

9. The case according to claim 7, wherein said flexible lip is in contact with a rib projecting from said case body.

10. The case according to claim 9, wherein said flexible lip presses in a sealed manner against said rib.

11. The case according to claim 9, wherein said lid comprises a rib of larger diameter than the rib of said case body, pressing against the flexible lip when the case is in a closed position.

12. The case according to claim 1, wherein said lid comprises two concentric annular ribs of respective diameters smaller than and greater than that of an annular rib projecting from said case body, and which press against a flexible annular lip of the seal one on each side of said annular rib.

13. The case according to claim 1, wherein the lid, when in a closed position, presses via the periphery of said lid against the flexible lip.

14. The case according to claim 1, wherein said seal comprises a peripheral part which in cross section has undulations and is in contact via a lower ridge against the case body.

15. The case according to claim 1, wherein said seal defines two annular grooves facing towards the case body, said annular grooves lying one on each side of a central groove facing towards the lid when the case is closed, and wherein said seal comprises further, at the bottom of the grooves that face towards the case body, rests molded integrally with said seal, said rests resting against the case body.

16. The case according to claim 15, wherein said lid comprises an annular rib which engages in said central groove when the case is closed.

17. The case according to claim 1, wherein said seal comprises a peripheral part which in cross section has a shape which overall is concave towards the case body, and wherein at least one stiffening element is provided inside the concave shape of the peripheral part.

18. The case according to claim 17, wherein said seal comprises a plurality of stiffening elements extending radially and molded integrally with the seal.

19. The case according to claim 18, wherein said seal comprises a stiffening element in the form of a continuous annular rib extending over the entire height of the peripheral part.

20. A case according to claim 17, wherein said seal comprises a stiffening element in the form of a discontinuous annular rib extending over the entire height of the peripheral part.

21. A case according to claim 1, wherein either the lid or the case body comprises at least one kidney bean slot and wherein either the case body or the lid, respectively, comprises a hinge pin engaged in the kikney bean slot, the arrangement of the kidney bean slot and of the hinge pin being such that when the lid is closed, the hinge pin can move in the kidney bean slot so that the lid pressses substantially uniformly against the seal.

22. A case comprising a lid and a case body provided with a housing for accommodating a reserve of substance contained in a cup, wherein said cup is extended by a seal, wherein at least a part of said seal, in an open position of said case, is separated from the case body by a free space, said free space extending both on an inner side and on an outer side of a portion of the case body which, at least when the case is in a closed position, is in contact with said seal, wherein an annular surface is formed on a ring secured to said seal to serve for the attachment of at least either one of a removable closure sheet and a mesh.

23. The case according to claim 22, wherein said case body is provided with a traversing aperture.

24. The case according to claim 22, wherein said seal is pressing in a sealed manner against said case body.

25. The case according to claim 22, wherein said seal has a skirt held by friction by a wall of a housing of said case body accommodating said cup.

26. The case according to claim 22, wherein said seal is overmolded onto said ring.

27. The case according to claim 22, wherein said lid presses in a sealed manner onto said seal when said lid is in a closed position.

28. The case according to claim 22, wherein said seal comprises a flexible lip.

29. The case according to claim 28, wherein said seal comprises at the base of said flexible lip a heel which contacts in a sealed manner said case body.

30. The case according to claim 28, wherein said flexible lip presses in a sealed manner against said case body.

31. The case according to claim 28, wherein said flexible lip presses in a sealed manner against the case body at the periphery of said flexible lip, even when the case is open.

32. The case according to claim 28, wherein said flexible lip is in contact with a rib projecting from said case body.

33. The case according to claim 32, wherein said flexible lip presses in a sealed manner against said rib.

34. The case according to claim 32, wherein said lid comprises a rib of larger diameter than the rib of said case body, pressing against the flexible lip when the case is in a closed position.

35. The case according to claim 28, wherein said lid presses on the flexible lip when the case is in a closed position without an appreciable compression of a free end of said flexible lip.

36. The case according to claim 22, wherein said lid comprises two concentric annular ribs of respective diameters smaller than and greater than that of an annular rib projecting from said case body, and which press against a flexible annular lip of the seal one on each side of said annular rib.

37. The case according to claim 28, wherein the lid, when in a closed position, presses via the periphery of said lid against the flexible lip.

38. The case according to claim 22, wherein said seal comprises a peripheral part which in cross section has undulations and is in contact via a lower ridge against the case body.

39. The case according to claim 22, wherein said seal comprises a peripheral part which in cross section has a shape which overall is concave towards the case body, and wherein at least one stiffening element is provided inside the concave shape of the peripheral part.

40. The case according to claim 22, wherein said seal comprises a plurality of stiffening elements extending radially and molded integrally with the seal.

41. The case according to claim 40, wherein said seal comprises a stiffening element in the form of a continuous annular rib extending over the entire height of the peripheral part.

42. The case according to claim 40, wherein said seal comprises a stiffening element in the form of a discontinuous annular rib extending over the entire height of the peripheral part.

43. The case according to claim 22, wherein either the lid or the case body comprises at least one kidney bean slot and wherein either the case body or the lid, respectively, comprises a hinge pin engaged in the kidney bean slot, the arrangement of the kidney bean slot and of the hinge pin being such that when the lid is closed, the hinge pin can move in the kidney bean slot so that the lid presses substantially uniformly against the seal.

44. A case, comprising a lid and a case body provided with a housing, said housing accommodating a reserve of substance contained in a cup, wherein said cup is extended by a seal, wherein said seal, at least in an open position of said case, is separated from the case body by a free space, said seal having an outer peripheral edge which is at a fixed position with respect to the case body, wherein an annular surface is formed on a ring serving for the attachment of at least either one of a removable closure sheet and a mesh.

45. The case according to claim 44, wherein said case body is provided with a traversing aperture.

46. The case according to claim 44, wherein said seal is pressing in a sealed manner against said case body.

47. The case according to claim 44, wherein seal has a skirt that is held by friction by a wall of a housing of said case body accommodating said cup.

48. The case according to claim 44, wherein said seal is overmolded onto said ring.

49. The case according to claim 44, wherein said lid presses in a sealed manner onto said seal when said lid is in a closed position.

50. The case according to claim 44, wherein said seal comprises a flexible lip.

51. The case according to claim 50, wherein said seal comprises at the base of said flexible lip a heel which contacts in a sealed manner said case body.

52. The case according to claim 50, wherein said flexible lip presses in a sealed manner against said case body.

53. The case according to claim 50, wherein said flexible lip presses in a sealed manner against the case body at the periphery of said lip, even when the case is open.

54. The case according to claim 50, wherein said flexible lip is in contact with a rib projecting from said case body.

55. The case according to claim 54, wherein said flexible lip presses in a sealed manner against said rib.

56. The case according to claim 54, wherein said lid comprises a rib of larger diameter than the rib of said case body, pressing against the flexible lip when the case is in a closed position.

57. The case according to claim 44, wherein said lid comprises two concentric annular ribs of respective diameters smaller than and greater than that of an annular rib projecting from said case body, and which press against a flexible annular lip of the seal one on each side of said annular rib.

58. The case according to claim 50, wherein the lid, when in a closed position, presses via the periphery of said lid against the flexible lip.

59. The case according to claim 44, wherein said seal comprises a peripheral part which in cross section has the overall shape of an inverted U comprising two arms housed in a groove of the case body and connected by an outwardly convex rounded part.

60. The case according to claim 58, wherein said lid comprises a projecting element which, via a lower end, is in contact with the outwardly convex rounded part when said lid is in a closed position.

61. The case according to claim 44, wherein said seal comprises a peripheral part which in cross section has undulations and is in contact via a lower ridge against the case body.

62. The case according to claim 44, wherein said seal defines two annular grooves facing towards the case body, said grooves lying one on each side of a central groove facing towards the lid when the case is closed, and wherein said seal comprises further, at the bottom of the grooves that face towards the case body, rests molded integrally with said seal, said rests resting against the case body.

63. A case according to claim 61, wherein said lid comprises an annular rib which engages in said central groove when the case is closed.

64. A case according to claim 44, wherein said seal comprises a peripheral part which in cross section has a shape which overall is concave towards the case body, and wherein at least one stiffening element is provided inside the concave shape of the peripheral part.

65. The case according to claim 44, wherein said seal comprises a plurality of stiffening elements extending radially and moulded integrally with the seal.

66. The case according to claim 63, wherein said seal comprises a stiffening element in the form of a continuous annular rib extending over the entire height of the peripheral part.

67. The case according to claim 63, wherein said seal comprises a stiffening element in the form of a discontinuous annular rib extending over the entire height of the peripheral part.

68. The case according to claim 44, wherein either the lid or the case body comprises at least one kidney bean slot and wherein either the case body or the lid, respectively, comprises a hinge pin engaged in the kidney bean slot, the arrangement of the kidney bean slot and of the hinge pin being such that when the lid is closed, the hinge pin can move in the kidney bean slot so that the lid presses substantially uniformly against the seal.

69. A case comprising:

a lid having an elastic member, a case body having a housing, and a cup containing a reserve of a substance, said cup being accommodated in the housing of said case body, wherein said cup is extended by a seal, at least a portion of said seal being, at least in an open position of said case, separated from the case body by a free space, and wherein said seal is configured for contacting the lid through the elastic member, wherein an annular surface is formed on a ring serving for the attachment of either one of a removable closure sheet and a mesh.

70. The case according to claim 69, wherein said case body is provided with a traversing aperture.

71. The case according to claim 69, wherein said seal is pressing in a sealed manner against said case body.

72. The case according to claim 69, wherein said seal has a skirt that is held by friction by a wall of a housing of said case body accommodating said cup.

73. The case according to claim 70, wherein said seal is overmolded onto said ring.

74. The case according to claim 69, wherein said lid presses in a sealed manner onto said seal when said lid is in a closed position.

75. The case according to claim 69, wherein said seal comprises a flexible lip.

76. The case according to claim 75, wherein said lid presses on the flexible lip when the case is in a closed position without an appreciable compression of a free end of said flexible lip.

77. The case according to claim 69, wherein said seal comprises a peripheral part which in cross section has the overall shape of an inverted U comprising two arms housed in a groove of the case body and connected by an outwardly convex rounded part.

78. The case according to claim 77, wherein said elastic member is in contact with the outwardly convex rounded part when said lid is in a closed position.

79. The case according to claim 69, wherein either the lid or the case body comprises at least one kidney bean slot and either the case body or the lid, respectively, comprises a hinge pin engaged in the kidney bean slot, the arrangement of the kidney bean slot and of the hinge pin being such that when the lid is closed, the hinge pin can move in the kidney bean slot so that the lid presses substantially uniformly against the seal.

80. A case comprising a lid and a case body provided with a housing, said housing accommodating a reserve of substance contained in a cup, wherein said cup is extended by a seal, and wherein said seal is in contact with said lid through at least two laterally spaced regions of said lid, wherein an annular surface is formed on a ring serving for the attachment of either one of a removable closure sheet and a mesh.

81. The case according to claim 80, wherein said case body is provided with a traversing aperture.

82. The case according to claim 80, wherein said seal is pressing in sealed manner against said case body.

83. The case according to claim 80, wherein said seal has a skirt held by friction by a wall of a housing of said case body accommodating said cup.

84. The case according to claim 80, wherein said seal is overmolded onto said ring.

85. The case according to claim 80, wherein said lid presses in a sealed manner onto said seal when said lid is in a closed position.

86. The case according to claim 80 wherein said seal comprises a flexible lip.

87. The case according to claim 86, wherein said seal comprises at the base of said flexible lip a heel which contacts in a sealed manner said case body.

88. The case according to claim 86, wherein said flexible lip presses in a sealed manner against said case body.

89. The case according to claim 86, wherein said flexible lip presses in a sealed manner against the case body at the periphery of said lip, even when the case is open.

90. The case according to claim 86, wherein flexible lip is in contact with a rib projecting from said case body.

91. The case according to claim 90, wherein flexible lip presses in a sealed manner against said rib.

92. The case according to claim 86, wherein said lid comprises a rib of larger diameter than the rib of said case body, pressing against the flexible lip when the case is in a closed position.

93. The case according to claim 80, wherein said lid comprises two concentric annular ribs of respective diameters smaller than and greater than that of an annular rib projecting from said case body, and which press against a flexible annular lip of the seal one on each side of said annular rib.

94. The case according to claim 80, wherein the lid, when in a closed position, presses via the periphery of said lid against the flexible lip.

95. The case according to claim 80, wherein said seal comprises a peripheral part which in cross section has undulations and is in contact via a lower ridge against the case body.

96. The case according to claim 80, wherein said seal defines two annular grooves facing towards the case body, said grooves lying one on each side of a central groove facing towards the lid when the case is closed, and wherein said seal comprises further, at the bottom of the grooves that face towards the case body, rests molded integrally with said seal, said rests resting against the case body.

97. The case according to claim 96, wherein said lid comprises an annular rib which engages in said central groove when the case is closed.

98. The case according to claim 80, wherein said seal comprises a peripheral part which in cross section has a shape which overall is concave towards the case body, and wherein at least one stiffening element is provided inside the concave shape of the peripheral part.

99. The case according to claim 80, wherein said seal comprises a plurality of stiffening elements extending radially and molded integrally with the seal.

100. The case according to claim 98, wherein said seal comprises a stiffening element in the form of a continuous annular rib extending over the entire height of the peripheral part.

101. The case according to claim 98, wherein said seal comprises a stiffening element in the form of a discontinuous annular rib extending over the entire height of the peripheral part.

102. The case according to claim 80, wherein either the lid or the case body comprises at least one kidney bean slot and wherein either the case body or the lid, respectively, comprises a hinge pin engaged in the kidney bean slot, the arrangement of the kidney bean slot and of the hinge pin being such that when the lid is closed, the hinge pin can move in the kidney bean slot so that the lid presses substantially uniformly against the seal.

* * * * *